US008460034B2

(12) United States Patent
Song et al.

(10) Patent No.: US 8,460,034 B2
(45) Date of Patent: Jun. 11, 2013

(54) MINIATURE ELECTRICAL CONNECTOR

(75) Inventors: Xiao-Jun Song, Shanghai (CN); Chiuming Lu, Taipei (TW)

(73) Assignee: Molex Incorporated, Lisle, IL (US)

( * ) Notice: Subject to any disclaimer, the term of this patent is extended or adjusted under 35 U.S.C. 154(b) by 6 days.

(21) Appl. No.: 13/133,975

(22) PCT Filed: Dec. 22, 2009

(86) PCT No.: PCT/CN2009/001532
§ 371 (c)(1),
(2), (4) Date: Aug. 26, 2011

(87) PCT Pub. No.: WO2010/072051
PCT Pub. Date: Jul. 1, 2010

(65) Prior Publication Data

US 2011/0300748 A1 Dec. 8, 2011

(30) Foreign Application Priority Data

Dec. 22, 2008 (CN) ..... 2008 2 0181736 U

(51) Int. Cl.
*H01R 13/648* (2006.01)

(52) U.S. Cl.
USPC ..... 439/607.36; 439/607.54

(58) Field of Classification Search
USPC ..... 439/607.36, 607.54, 607.4
See application file for complete search history.

(56) References Cited

U.S. PATENT DOCUMENTS

| | | | | |
|---|---|---|---|---|
| 5,281,169 | A | 1/1994 | Kiat et al. | |
| 5,865,646 | A | 2/1999 | Ortega et al. | |
| 6,007,382 | A | 12/1999 | Wu | |
| 6,231,403 | B1 | 5/2001 | Casey et al. | |
| 6,454,603 | B2 | 9/2002 | Casey et al. | |
| 6,554,646 | B1 | 4/2003 | Casey | |
| 6,733,339 | B2 | 5/2004 | Casey | |
| 6,986,681 | B2 * | 1/2006 | Tsai | 439/607.36 |
| 7,351,105 | B2 * | 4/2008 | Delaney et al. | 439/607.36 |
| 7,645,165 | B2 * | 1/2010 | Wu et al. | 439/607.38 |
| 7,727,019 | B2 * | 6/2010 | Droesbeke et al. | 439/607.35 |
| 7,997,937 | B2 * | 8/2011 | Kondo | 439/660 |

FOREIGN PATENT DOCUMENTS

| | | | |
|---|---|---|---|
| CN | 2862407 | Y | 1/2007 |
| CN | 101262094 | A | 9/2008 |
| CN | 201360060 | Y | 12/2009 |
| TW | M290324 | | 5/2006 |
| TW | M304129 | | 1/2007 |

OTHER PUBLICATIONS

International Search Report for PCT/CN2009/001532.

* cited by examiner

*Primary Examiner* — Gary F. Paumen
(74) *Attorney, Agent, or Firm* — Stephen L. Sheldon

(57) ABSTRACT

An electrical connector includes a cage, a body, positioned in the cage, and several terminals positioned on the body. The body has a front end and opposing rear end. The cage also has a front end and a rear end corresponding to the front and rear end of the body. The cage includes a top plate, a bottom plate and two lateral plates. A rear cover corresponding to the rear end of the body bend and extends from a rear end of the top plate of the cage. Two soldering pieces bend and extend from a bottom end of the rear cover toward the front end of the cage.

10 Claims, 5 Drawing Sheets

MINIATURE ELECTRICAL CONNECTOR

RELATED APPLICATIONS

This application is a national phase of PCT Application No. PCT/CN09/001532, filed Dec. 22, 2009, which in turn claims priority to Chinese Application No. 200820181736.3, filed Dec. 22, 2008, both of which are incorporated herein by reference.

TECHNICAL FIELD

The present invention relates to an electrical connector, and more particularly to a miniature electrical connector that can be installed on a circuit board.

BACKGROUND OF THE INVENTION

Please refer to FIG. 1 and FIG. 2 for the electrical connector disclosed in Taiwan new model patent M304129 (Application No.: 95206946). It discloses a body 11, a row of conductive terminals 12 on the body 11, and a cage 13 covering the body 11. The cage 13 comprises a top wall 131, a bottom wall 132, two side walls 133, and a rear wall 134 extending downward from the rear edge of the top wall 131, wherein the bottom end of the rear wall 134 extends downward into a second connecting leg 135. In the present embodiment, this second connecting leg 135 bends backward in the direction of the rear wall 134, thus taking up space that could be used by a circuit board.

As shown in FIG. 3, the second connecting leg 135' of this embodiment is formed by extending straight down, and so it is a perforated connecting leg. Therefore, the circuit board must have matching perforations. These perforations sacrifice space for each layer in a multilayer circuit board and thus influence the routing configuration of each layer.

In addition, the above discussed electrical connector is connected to a butting connector, therefore this electrical connector will need to withstand insertion/withdrawal force during plugging and unplugging. However, in the two preceding embodiments, when the connector undergoes a number of insertions and removals or when it receives considerable insertion/withdrawal force, the second connecting leg 135 or 135' is likely to bend, thus making an increase in the distance between the rear wall 134 and cage 13 likely, and so influencing the stability of the electrical connector. Therefore, the two embodiments must bend the two sides of the rear wall 134 into side wings 136 with two wedging blocks 137 to be clamped onto the two side walls 133 in order to stabilize the rear wall 134 and the cage 13, which requires labor and increases costs.

SUMMARY OF THE INVENTION

An electrical connector comprises a cage, a body situated inside the cage, and a plurality of conductive terminals arranged on this body. The body has a front end and a back end opposite each other, and the cage has a front end and back end corresponding to the front end and back end of the body; the cage comprises a top plate, two side plates, and a base plate, the back end of the cage's top plate bends and extends into a rear cover that corresponds to the back end of the body. Two soldering tabs extend from a bottom end of the rear cover toward the front end of the cage.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated from the following disclosure, the use of soldering tabs that bend and extend forward from the rear cover of the cage and can be positioned under the body helps form a structure covering the back end of the body. Compared to certain existing designs and technologies, after the two soldering tabs are soldered to the circuit board, the assembly of the body and cage quite stable and enables it to withstand considerable insertion/withdrawal force. In addition, it is possible to save circuit board space. Furthermore, the depicted design potentially offers advantages and improves on the existing need for the rear wall of the cage to have the additional structural design of being bent and clamped to the side walls, allowing for savings on labor and manufacturing costs.

Figure 1:
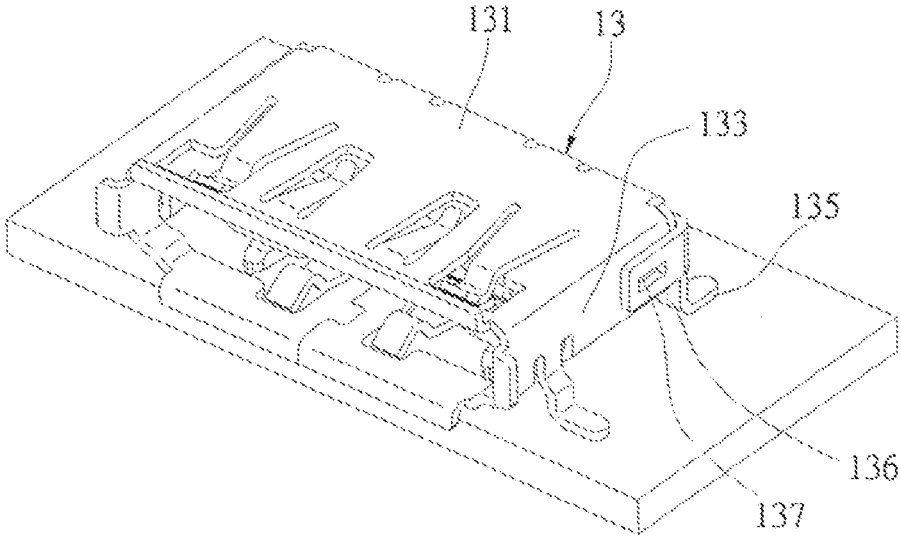
FIG. 1 is a perspective view of an existing electrical connector.
Figure 2:
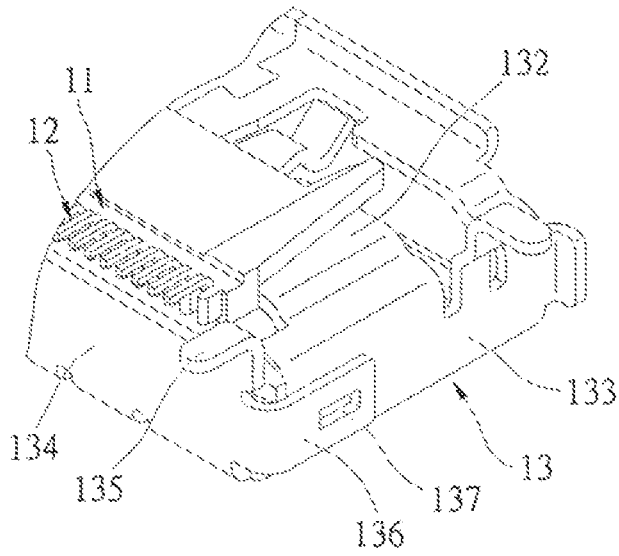
FIG. 2 is a partial rear perspective view of an existing electrical connector.
Figure 3:
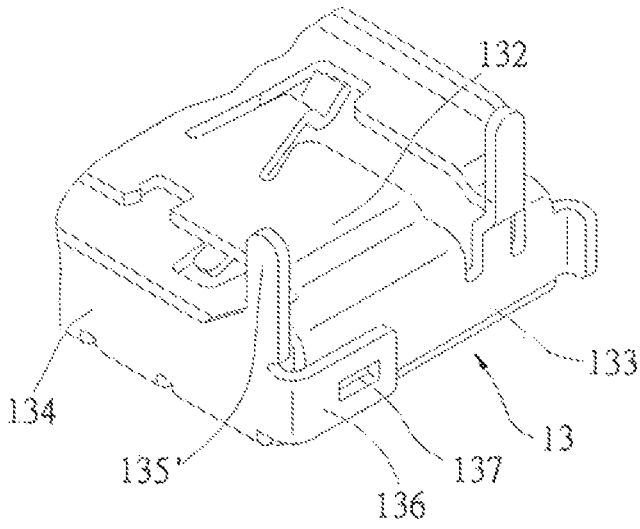
FIG. 3 is a partial rear perspective view of another embodiment of an existing electrical connector, showing only the cage.
Figure 4:
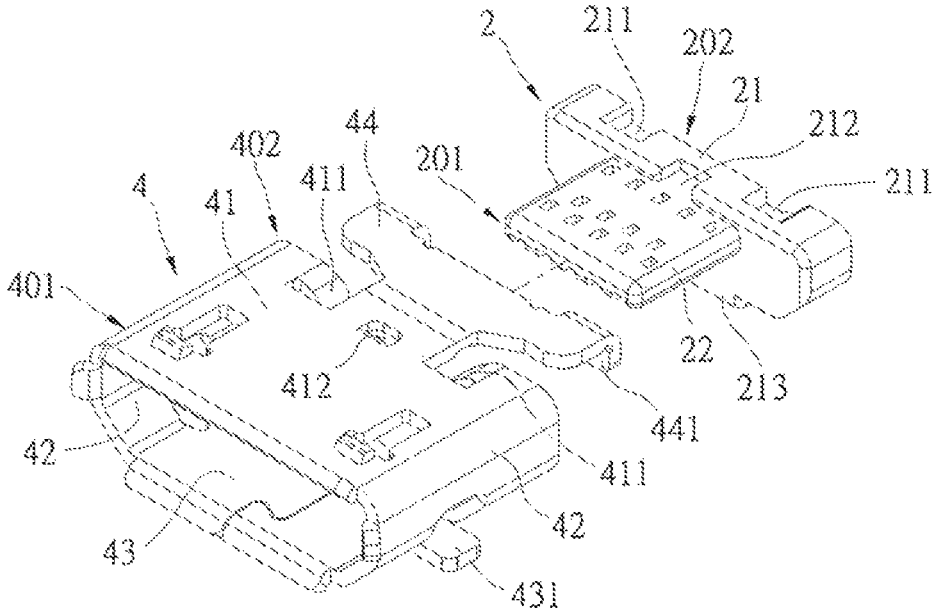
FIG. 4 is a perspective exploded view of an embodiment of an electrical connector, in which the rear cover of the cage has not been bent.
Figure 5:
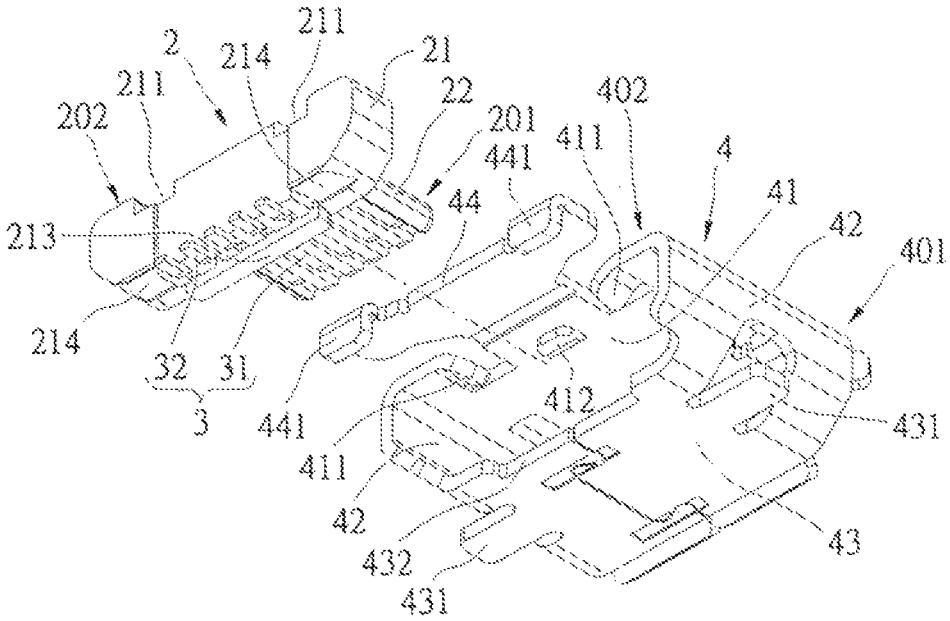
FIG. 5 is another perspective exploded view of the electrical connector depicted in FIG. 4.

Referring to FIGS. 4 and 5, an electrical connector which comprises a body 2, which may be formed of an insulative material, a plurality of conductive terminals 3, and a cage 4. The body 2 has a front end 201 and a back end 202 opposite each other, and in the present embodiment, the body 2 comprises a base 21 and a tongue 22 that follows the direction of the front end 201 and is connected to the face of the base 21. The top part of the base 21 can have two recesses 211 along the back end 202 toward the front end 201, there can be a notch 212 in the top part of the base 21 along the front end 201 toward the back end 202, the base of the base 21 can have a protruding block 213 protruding downward, and the base of the base 21 can also have two upward concave parts 214.

The conductive terminals 3 are arranged in a row on the body 2, each conductive terminal 3 has a contact part 31 and a soldering leg 32, the contact part 31 is positioned in the direction of the front end 201 of the body 2, and the soldering leg 32 bends and extends out of the back end 202 of the body 2. In an embodiment, the contact part 31 is located on the tongue 22 and is visible on the base of the tongue 22, and the soldering leg 32 bends and extends out of the base of the base 21.

Figure 6:
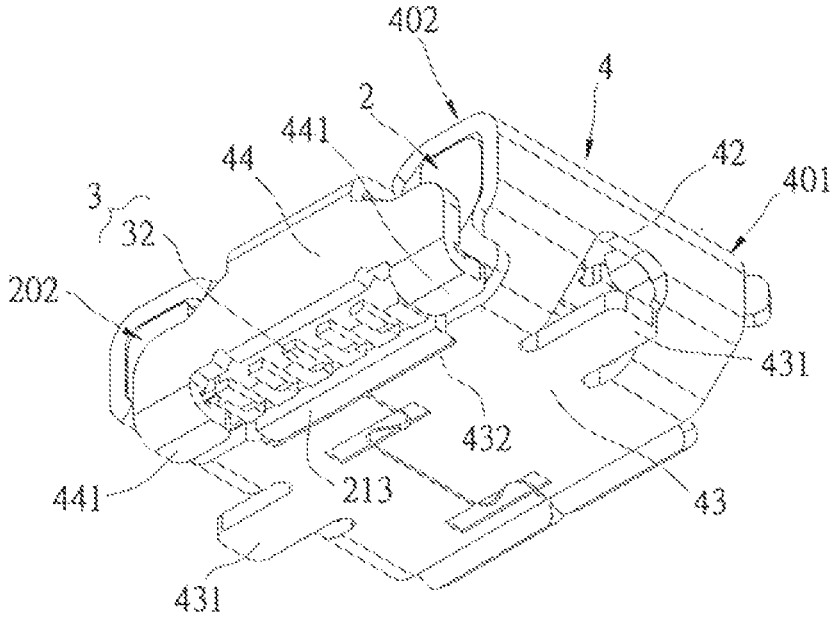
FIG. 6 is a perspective assembly view of an embodiment of an electrical connector.

The cage 4 can be made by stamping and bending a metal plate, and it has a front end 401 and back end 402 corresponding to the front end 201 and back end 202 of the body 2. The cage 4 also includes a top plate 41, two side plates 42 opposite each other and connected to the top plate 41, and a base plate 43 connected to the bottom ends of the two side plates 42. Extending out beyond the back end 402 of the top plate 41 is a rear cover 44, as shown in FIG. 6, and after the rear cover 44 is bent into position, corresponds to the back end 202 of the body 2. Two soldering tabs 441 are provided at a bottom end of the rear cover 44 and the soldering tabs bends and extends toward the front end 401 of the cage 4.

In an embodiment, the two soldering tabs 441 of the cage 4 are positioned below the body 2 and free ends of the two soldering tabs 441 are near the back end 402 of the base plate 43. The top plate 41 can be bent inward and extended at locations toward the back end 402 to form two stop plates 411 and can have a stop part 412 protruding inward at a location toward the back end 402. In addition, the base plate 43 of the cage 4 can extend out at each of the two side ends into auxiliary soldering tabs 431.

As depicted, when the body 2 and the cage 4 are assembled, the rear cover 44 of the cage 4 can remain unbent, and the body 2 can be installed from back to front inside the cage 4, allowing the cage 4 to cover the body 2 and conductive terminals 3. After the rear cover 44 of the cage 4 is bent, the rear cover 44 can be aligned with the back end 202 of the body 2. The rear cover can help position the body 2 and conductive terminals 3 inside the cage 4, and the two soldering tabs 441 can face the direction of the front end 401 of the cage 4. In addition, the soldering legs 32 of the conductive terminals 3 are gathered and arranged between the two soldering tabs 441.

In further explanation, when the body 2 is installed from back to front inside the cage 4, the stop part 412 of the top plate 41 corresponds to the notch 212 of the body 2 and can be fastened into the notch 212 while the two stop plates 411 of the top plate 41 correspond to the two recesses 211 of the body 2 and can extend into the recesses 211. In addition, a rear edge face 432 of the base plate 43 can stop the protruding block 213 of the body 2. Consequentially, it is possible to accurately install the body 2 inside the cage 4 and hold the body 2 securely. In this process, after the body 2 is installed inside the cage 4 and the rear cover 44 is bent, the top plate 41, two side plates 42, rear cover 44 and soldering tabs 441 can cover the back end 202 of the base 21, causing the two soldering tabs 441 of the cage 4 to be positioned under the body 2.

Figure 7:
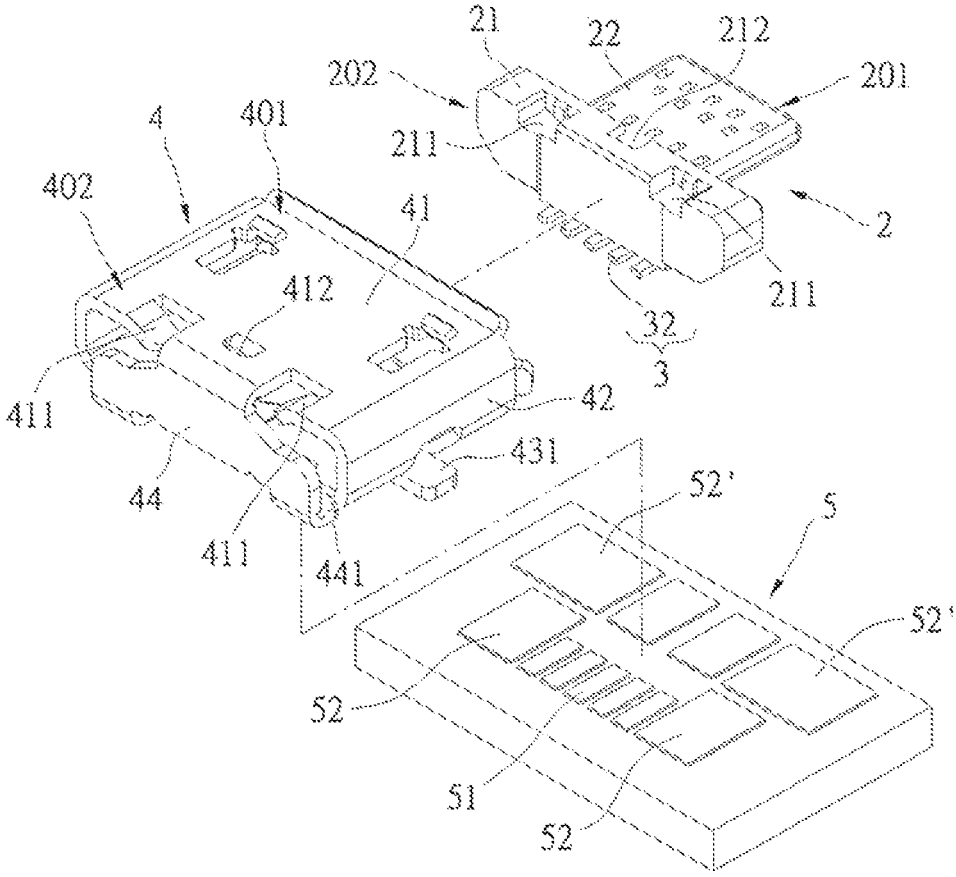
FIG. 7 is a perspective exploded view of an embodiment of an electrical connector installed on a circuit board, showing the body and cage separated from each other.
Figure 8:
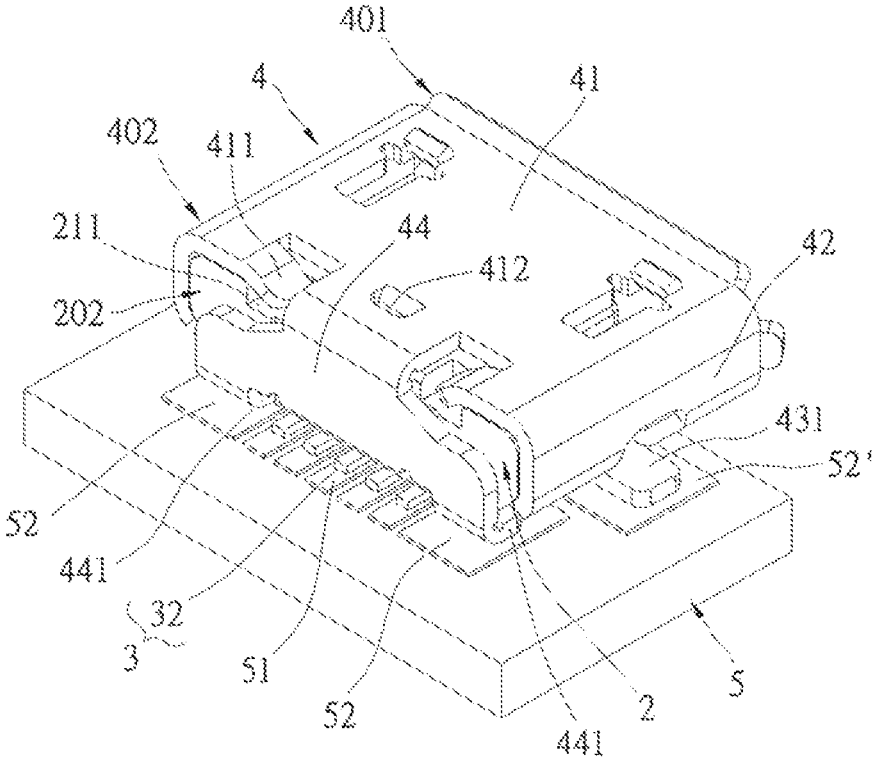
FIG. 8 is a perspective assembly view of an embodiment of an electrical connector installed on a circuit board.
Figure 9:
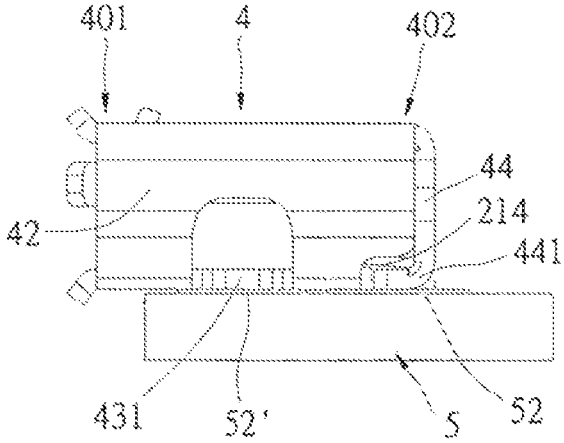
FIG. 9 is an elevated side view of an electrical connector installed on a circuit board.

Looking at FIGS. 7-9, the electrical connector can be installed on a circuit board 5 with conductive pads 51 and soldering pads 52, the soldering legs 32 of the conductive terminals 3 are soldered to the corresponding conductive pads 51, and the two soldering tabs 441 bending forward from the cage 4 can be soldered to the soldering pads 52 of the circuit board 5, thus fixing the electrical connector to the circuit board 5.

Therefore, embodiments of the depicted electrical connector can be mated to a matching butting connector (not pictured). As can be appreciated, insertion/withdrawal forces are generated during insertion and removal of a mating connector. As depicted, the soldering tabs 441 bend forward from the rear cover 44 and are positioned under the body 2. Together with the rear cover 44, the soldering tabs 441 form a structure covering the back end 202 of the body 2. Once the soldering tabs 441 are soldered to the circuit board 5, the assembly of the body 2 and cage 4 are quite stable and, therefore, are able to withstand considerable insertion/withdrawal force during insertion and removal of a mating connector. As can be appreciated, this helps address the problem of a desiring an increase in the space between the rear cover 44 and the cage 4, which could also influence the stability of the electrical connector. Instead, the structural design of additionally bending and extending the two side ends of the rear cover 44 and clamping them to the side plates 42 is no longer necessary. In addition, the two soldering tabs 441 of the rear cover 44 are made by bending and extending them forward; they are not bent and extended backward; therefore, the distance resulting from backward bending is reduced; at the same time. Furthermore, the two soldering tabs 441 are not perforated soldering tabs requiring the circuit board to have matching perforations, which could influence the routing configuration of each layer of the circuit board. Therefore, using the two soldering tabs 41 design can save circuit board space.

It should be noted that the free ends of the two soldering tabs 441 of the cage 4 are near the back end 402 of the base plate 43. As can be appreciated, therefore, solder (not pictured) can be used to solder the two soldering tabs 441 to the base plate 43, and it can also be used to solder the back end 402 of the base plate 43 and the soldering tabs 441 to the circuit board 5. The, the increased soldering area can help make the assembly of the body 2 and cage 4 more stable, and enable it to withstand greater insertion/withdrawal force.

In addition, the depicted configuration causes the two soldering tabs 441 to extend toward the front end 401, and it causes the soldering legs 32 of the conductive terminals 3 to be gathered and arranged between the two soldering tabs 441 This can have a benefit on the circuit board routing configurations.

Furthermore, the base plate 43 of the cage 4 also extends into two auxiliary soldering tabs 431, and these are available for connection to the corresponding soldering pads 52' of the circuit board 5. As can be appreciated, this can further improve the stability of the cage 4 and body 2 and can enable them to withstand even higher insertion/withdrawal force. In addition, the two soldering tabs 441 of the cage 4 can be positioned in their respective, corresponding concave parts 214 of the body 2 (as shown in FIG. 9), thus further reducing the overall size and height in order to help the electrical connector meet the goal of miniaturization.

The preceding description is only a preferred embodiment of the present invention and is not intended to limit the scope of the patent of the present invention. Therefore, all equivalent structural changes made in the utilization of the content of the description and attached Figures of the present invention shall accordingly be included within the scope of the present invention.

We claim:

1. An electrical connector, comprising:

a cage including a top plate, a base plate, a front end and a back end;

a body positioned in the cage, the body having a front end and a back end opposing the front end, the front and back end of the body corresponding to the front and back end of the cage;

a plurality of conductive terminals supported by the body;

a rear cover that extends from the back end of the top plate in a downward direction so as to cover the back end of the body; and two soldering tabs that extend from a bottom end of the rear cover, the two tabs extending toward the front end of the cage.

2. The electrical connector of claim 1, wherein the soldering tabs bending and extending from the rear cover are positioned under the body.

3. The electrical connector of claim 2, wherein the base of the body has two concave parts and each of the soldering tabs of the cage are positioned in one of the two concave parts.

4. The electrical connector of claim 2, wherein the described conductive terminals have soldering legs bending and extending out from the back end of the body, and these soldering legs are positioned between the two soldering tabs of the cage.

5. The electrical connector of claim 1, wherein the soldering tabs each have a free end and the free end of each of the soldering tabs is adjacent the back end of the base plate.

6. The electrical connector of claim 5, wherein the two soldering tabs are soldered to the back end of the base plate.

7. The electrical connector of claim 6,wherein a first and second auxiliary soldering tab extend out from opposing sides of the base plate.

8. The electrical connector of claim 7, further comprising a stop plate that extend from the top plate of the cage, wherein the body has corresponding recess and the stop plate is bent so as to extend into the recess.

9. The electrical connector of claim 8, wherein the top plate has a stop part, the body has a notch corresponding to the stop part, and the stop part is positioned in the notch.

10. The electrical connector of claim 9, wherein the body has a protruding block and a rear edge face of the base plate engages the protruding block.

* * * * *